United States Patent [19]

Simon

[11] 4,414,927

[45] Nov. 15, 1983

[54] TWO STROKE OSCILLATING PISTON ENGINE

[76] Inventor: Istvan Simon, Otterngutstrasse 37, CH-8200 Schaffhausen, Switzerland

[21] Appl. No.: 368,985

[22] Filed: Apr. 16, 1982

[51] Int. Cl.[3] ..... F02B 33/06; F02B 1/08; F02B 75/28

[52] U.S. Cl. ..... 123/62; 123/69 R; 123/57 B; 123/56 BC; 123/61 R

[58] Field of Search ..... 123/62, 69 R, 69 V, 123/61 R, 61 V, 57 B, 56 BC, 56 L

[56] References Cited

U.S. PATENT DOCUMENTS

| | | | |
|---|---|---|---|
| 976,858 | 11/1910 | Easthope, Jr. | 123/69 R |
| 1,065,250 | 6/1913 | Huntington | 123/62 |
| 1,372,391 | 3/1921 | Barner | 123/57 B |
| 1,651,147 | 11/1927 | Morris et al. | 123/62 |
| 2,398,221 | 4/1946 | Gerhardt | 123/62 |
| 2,508,391 | 5/1950 | Huntington | 123/69 R |
| 2,963,008 | 12/1960 | Waldrop | 123/62 X |

*Primary Examiner*—Wendell E. Burns
*Attorney, Agent, or Firm*—Saul Jecies

[57] ABSTRACT

A two stroke oscillating piston engine comprising cylinder sections provided with feed chambers for additional fresh air. The two outer rings, acting as pistons, draw in fresh air through intake ports and force that air to enter combustion chambers through communication ducts and ports. The middle ring is intended for the fresh gas supply of the combustion chambers. The radial grooves for fresh air are provided at a shorter distance from the ports than the radial grooves for fresh gas. Burnt and expanded gas is first exhausted from the combustion chambers by fresh gas; then the combustion chambers are filled with fresh gas and fresh air. Thus, exhausting unburnt gas together with burnt gas is avoided and improved combustion is provided in the combustion chambers.

4 Claims, 5 Drawing Figures

TWO STROKE OSCILLATING PISTON ENGINE

The invention involves a two stroke oscillating piston engine with at least one reciprocating piston barrel and a corresponding number of hollow cylinders designed for two stroke operation and provided with fresh gas intake ports, fresh gas communication ducts and exhaust gas outlet ports, with this hollow cylinder composed of parallel sections bolted together and with the piston barrel actively connected with a crank gear so that the radial component forces on the piston barrel are kept as low as possible.

One free piston engine without crank gear and without fresh air input by Franz Stelzer has already been patented.

The problem was to burn the supplied fuel of the combustion gas as completely as possible in the engine expansion chamber.

The invention solves this problem by means of an engine, characterized in that the piston barrel has a cylindrical shaft on which are fitted three cylinder-shaped rings acting as pistons, that the hollow cylinder surrounding the piston barrel has in its longitudinal center a cylinder section that is symmetrical with regard to this center and whose axial bore is divided by the middle ring of the piston barrel into two fresh gas feed chambers, with this cylinder section displaying, symmetrically to its longitudinal center, two fresh gas intake ports arranged side by side, and with the feed chambers connected at their outer ends each by one radial groove with the corresponding fresh gas communication duct, that on both front faces of the middle cylinder section is provided the same partition with the passing section of the pertaining fresh gas communication duct, that then and on these two partitions are assembled two reciprocally symmetrical working cylinder sections whose axial bores are divided by the two outer rings of the piston barrel into one inner combustion chamber and one outer fresh air feed chamber, that in the longitudinal center, at least, of these working cylinder sections are arranged two radial ports side by side, with the inner ports designed as exhaust gas outlet ports and the outer ports as fresh air intake ports, and that, diametrically opposed to the exhaust gas outlet ports, one radial communication port each leads to the pertaining fresh gas communication duct and at the outer ends of the fresh gas feed chambers, one radial fresh air groove each leads to the corresponding fresh gas communication duct.

The drawing shows an exemplary design of the object of the invention. Thus:

Figure 1:
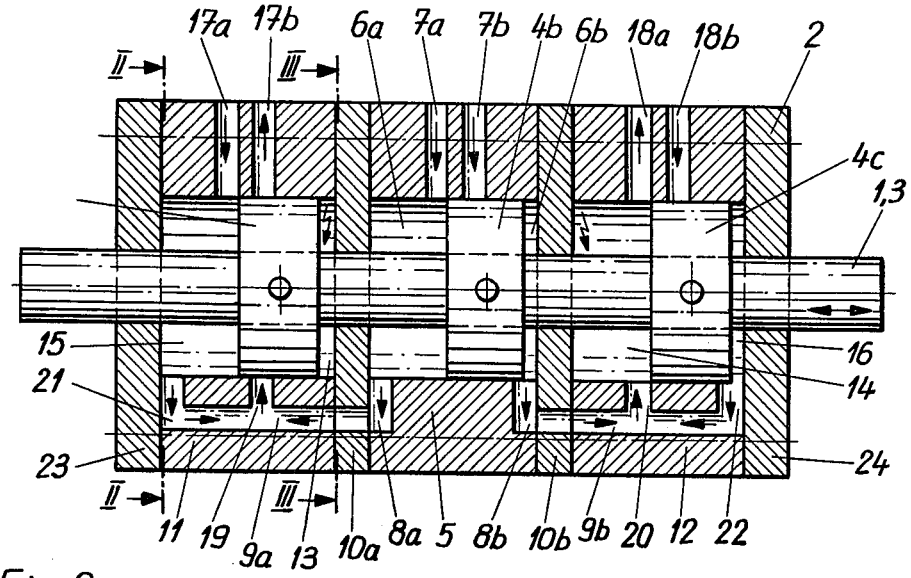
FIG. 1 shows a longitudinal section through the hollow cylinder.

The represented two stroke oscillating piston engine has at least one reciprocating piston barrel 1 surrounded by a hollow cylinder 2 composed of several parallel sections bolted together coaxially (FIG. 1). Piston barrel 1 is actively connected with a special crank gear not shown in the drawing and the crank bolt of which is supported in a slide pivot that oscillates at right angles to the longitudinal axis of piston barrel 1, with the gear section that houses the slide pivot firmly connected with piston barrel 1. The slide pivot is designed to keep the radial component forces on the piston barrel as low as possible by by-passing the connecting rod.

Figure 3:
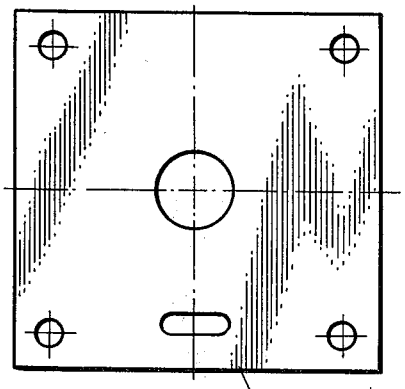
FIG. 3 shows a view, in the direction of pointers III—III of FIG. 1, of the left partition.
Figure 5:
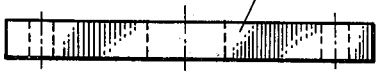
FIG. 5 shows a plan view for FIG. 3.

Piston barrel 1 has a cylindrical shaft 3. Onto this shaft are cotter-pinned three cylinder-shaped rings 4*a*, 4*b*, 4*c* acting as pistons. Hollow cylinder 2 is symmetrical where its longitudinal center is concerned, also the middle hollow cylinder section 5. The axial bore of the cylinder section 5 is divided by the middle ring 4*b* into two fresh gas feed chambers 6*a*, 6*b*. Symmetrically as regards its longitudinal center, the cylinder section 5 displays two fresh gas intake ports 7*a*, 7*b* arranged side by side. The outer ends of the feed chambers 6*a*, 6*b* of hollow cylinder section 5 are each connected by one communication radial groove 8*a*, 8*b* with one left or one right fresh gas communication duct 9*a*, 9*b*. On both front faces of the middle cylinder section 5 are provided similar partitions 10*a*, 10*b* with a passing section of the corresponding fresh gas communication duct 9*a*, 9*b* (FIGS. 3, 5).

After these two partitions 10*a*, 10*b* and toward the longitudinal center of hollow cylinder 2 are assembled two symmetrical working cylinder sections 11, 12 whose axial bores are divided by the two outer rings 4*a*, 4*c* of piston barrel 1 into one inner chamber each as combustion chamber 13, 14 and one outer chamber each as fresh air feed chamber 15, 16. About in the longitudinal center, at least, of these working cylinder sections 11, 12 are provided two radial ports each. The outer ports serve as fresh air intake ports 17*a*, 18*b* and the inner ports as exhaust gas outlet ports 17*b*, 18*a*.

Figure 2:
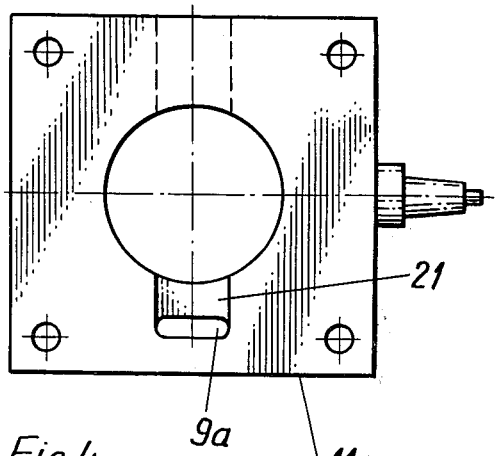
FIG. 2 shows a view, in the direction of pointers II—II of FIG. 1, of the left working cylinder section with cover plate removed.
Figure 4:
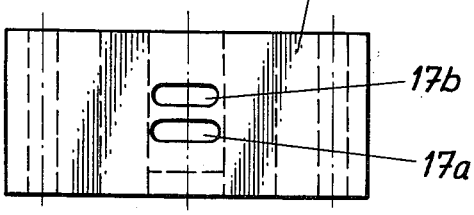
FIG. 4 shows a plan view for FIG. 2

Diametrically opposed to the exhaust gas outlet ports 17*b*, 18*a* are provided radial ports 19, 20 which connect the fresh gas communication ducts 9*a*, 9*b* temporarily with the combustion chambers 13, 14. At their outer ends, the fresh air feed chambers 15, 16 are connected by radial grooves 21, 22 with the fresh gas communication ducts 9*a*, 9*b* (FIGS. 2, 4). The two working cylinder sections 11, 12 are sealed in the axial direction by one outer wall 23, 24 each.

With each piston movement to the left, the ignited gas mixture in the combustion chamber 13 between the left partition 10*a* and the left outer ring 4*a* expands. Subsequently, fresh air is feed through this left outer ring 4*a* and fresh gas through the middle ring 4*b* to exhaust the burnt expanded gas while the outer right ring 4*c* compresses fresh gas with feed fresh air in the combustion chamber 14. With the piston movement to the right, the corresponding actions take place accordingly.

As FIG. 1 shows, the distance separating the radial fresh air grooves 21, 22 from the radial communication ports 19, 20 is shorter compared to the distance separating the radial fresh gas grooves 8*a*, 8*b* from the radial communication ports 19, 20. The result of this is that fresh air is first used to exhaust the burnt gas, with fresh gas together with feed fresh air filling subsequently the combustion chamber 13. This prevents any exhausting of unburnt fresh gas with the burnt gas. In addition, the fresh air feed causes improved combustion of the fuel in the combustion chamber.

Several hollow cylinders 2 and piston barrels 1 may be provided for torque compensation.

I claim:

1. A two stroke oscillating piston engine with at least one reciprocating piston barrel and a corresponding number of hollow cylinders designed for two stroke operation and provided with fresh gas intake ports, fresh gas communication ducts and exhaust gas outlet ports, with this hollow cylinder composed of parallel sections bolted together and with the piston barrel actively connected with a crank gear so that the radial component forces on the piston barrel are kept as low as possible, characterized in that the piston barrel has a cylindrical shaft on which are fitted three cylinder-shaped rings acting as pistons, that the hollow cylinder surrounding the piston barrel has in its longitudinal center a cylinder section that is symmetrical with regard to this center and whose axial bore is divided by the middle ring of the piston barrel into two fresh gas feed chambers, with this cylinder section displaying, symmetrically to its longitudinal center, two fresh gas intake ports arranged side by side, and with the feed chambers connected at their outer ends each by one radial groove with the corresponding fresh gas communication duct, that on both front faces of the middle cylinder section is provided the same partition with the passing section of the pertaining fresh gas communication duct, that then and on these two partitions are assembled two reciprocally symmetrical working cylinder sections whose axial bores are divided by the two outer rings of the piston barrel into one inner combustion chamber and one outer fresh air feed chamber, that in the longitudinal center, at least, of these working cylinder sections are arranged two radial ports side by side, with the inner ports designed as exhaust gas outlet ports and the outer ports as fresh air intake ports, and that, diametrically opposed to the exhaust gas outlet ports, one radial communication port each leads to the pertaining fresh gas communication duct and at the outer ends of the fresh gas feed chambers, one radial fresh air groove each leads to the corresponding fresh gas communication duct.

2. A two stroke oscillating piston engine according to claim 1, characterized in that the distance separating the radial fresh air grooves from the radial communication ports is smaller compared to the distance separating the radial fresh gas grooves from the radial communication ports.

3. A two stroke oscillating piston engine according to claim 1, characterized in that the two working cylinder sections are sealed by one outer wall each.

4. A two-stroke oscillating piston engine comprising:

a hollow cylinder;

2 partition walls spaced substantially equidistant from the longitudinal center of said cylinder and dividing said cylinder into a central gas inlet space;

a first combustion space on one side of said central gas inlet space, and;

a second combustion space on the other side of said central gas inlet space;

a piston rod for reciprocating in said hollow cylinder;

a central piston carried by said piston rod for reciprocating in said central gas inlet space;

a first piston having a predetermined axial width carried by said piston rod for reciprocating in said first combustion space;

a second piston having a predetermined width carried by said piston rod for reciprocating in said second combustion space;

a first and second gas inlet aperture in said hollow cylinder communicating with said central gas inlet space and spaced so that said center piston opens one of the said gas inlet apertures while closing the other of said gas inlet apertures;

first conduit means to connect said central gas inlet space with said first combustion space;

a first air inlet aperture located in said cylinder near the outer end of said first combustion space;

a first exhaust aperture in said cylinder spaced inwardly from said first air inlet aperture;

a second air inlet aperture located in said cylinder near the outer end of said second combustion space;

a second exhaust aperture in said cylinder spaced inwardly from said second air inlet aperture;

reciprocating movement of said center piston away from that first combustion space opening said first gas inlet aperture;

reciprocating movement of said center piston towards said second combustion space opening said second gas inlet aperture while closing said first gas inlet aperture;

the predetermined width of said first and second piston being of a dimension in relation to the locations of said air inlet apertures and said exhaust apertures being arranged so that said first and second pistons alternately close and open the respective air inlet and exhaust apertures in the respective combustion spaces.

* * * * *